US005936189A

United States Patent [19]

Lubbers

[11] Patent Number: 5,936,189

[45] Date of Patent: Aug. 10, 1999

[54] CARTRIDGED AMMUNITION

[75] Inventor: Willi Lubbers, Kuddeworde, Germany

[73] Assignee: Nico-Pyrotechnik Hanns Jurgen Diederichs GmbH & Co., Trittan, Germany

[21] Appl. No.: 09/000,162

[22] PCT Filed: Jul. 22, 1996

[86] PCT No.: PCT/DE96/01388

§ 371 Date: May 11, 1998

§ 102(e) Date: May 11, 1998

[87] PCT Pub. No.: WO97/05445

PCT Pub. Date: Feb. 13, 1997

[30] Foreign Application Priority Data

Jul. 28, 1995 [DE] Germany ..... 195 27 621

[51] Int. Cl.[6] ..... F42B 5/02

[52] U.S. Cl. ..... 102/439; 102/469; 102/513

[58] Field of Search ..... 102/334, 430, 102/439, 440, 441, 469, 470, 513

[56] References Cited

U.S. PATENT DOCUMENTS

| | | | |
|---|---|---|---|
| 3,431,852 | 3/1969 | Fowler | 102/334 |
| 3,967,552 | 7/1976 | Settles et al. . | |
| 3,983,817 | 10/1976 | Tucker | 102/513 |
| 4,892,038 | 1/1990 | Lubbers | 102/513 |
| 4,907,511 | 3/1990 | Bulman . | |
| 4,938,146 | 7/1990 | Gunther et al. | 102/439 |

FOREIGN PATENT DOCUMENTS

| | | |
|---|---|---|
| 2331770 | 10/1977 | France . |
| 298055 | 12/1919 | Germany . |
| A-3918005 | 5/1990 | Germany . |

*Primary Examiner*—Harold J. Tudor
*Attorney, Agent, or Firm*—Blank Rome Comisky McCauley LLP

[57] ABSTRACT

The cartridged ammunition comprises a projectile (11) and a cartridge case (10) receiving the latter. The cartridge case (10) contains a cartridge (12) limiting a high-pressure space (21) in which a propelling charge (14) is located. The cartridge (12) is surrounded by a low-pressure space (10*a*) limited by the inside walls of the cartridge case (10) and a part of the base of the projectile (11). At the rear of the projectile (11) a tracer composition (11*b*) is arranged in a tube (27) which protrudes through the upper wall of the cartridge (12) into the high-pressure space (21). Projectile and cartridge case are interconnected via a rated breaking point (12*d*). The pressure for expelling the projectile (11) from the cartridge case is supplied by the pressure both in the high-pressure space (21) and in the low-pressure space (10*a*). Upon expulsion the volume of the high-pressure space (21) is furthermore enlarged when the tracer composition is pulled out thereof. These measures avoid steep pressure peaks in the march of pressure upon expulsion of the projectile. At the same time, approximately the entire projectile volume is available for a service charge.

11 Claims, 2 Drawing Sheets

CARTRIDGED AMMUNITION

BACKGROUND OF THE INVENTION

This invention relates to cartridged ammunition, in particular practice ammunition for a grenade pistol or the like, for example with a 40 mm caliber.

The invention starts out from ammunition according to the applicant's EP-B-0215042. The projectile received in a cartridge case has a smoke charge as a service charge and carries a tracer composition at the rear. The cartridge case has an ignition charge and a propelling charge ignited thereby for expelling the projectile from the cartridge case. The propelling charge is received in a cartridge located centrally in the cartridge case and forming a high-pressure space. The cartridge is surrounded by a low-pressure space which is further limited by the inside walls of the cartridge case and a part of the projectile base and is connected with the high-pressure space via tamped overflow openings. Further, the upper closing wall of the cartridge has a small igniting channel opening into the tracer composition disposed at the rear of the projectile. The projectile is connected with the cartridge which has a rated breaking point below the connecting point.

When the propelling charge is ignited via the ignition charge a pressure builds up in the high-pressure space but does not suffice to burst the rated breaking point and expel the projectile. The tracer composition is ignited via the small igniting bore. As soon as the tamping between high-pressure space and low-pressure space breaks open, the propellant gases enter the low-pressure space via the overflow openings and act on the remaining part of the projectile base. When the pressures in the high-pressure and low-pressure spaces are high enough, the rated breaking point breaks open, thereby expelling the projectile from the cartridge case. The trajectory of the projectile is subsequently marked by the burning tracer composition.

The division of the pressure space for expelling the projectile into a high-pressure space and a low-pressure space causes the forces produced in the two pressure spaces cooperate in breaking open the rated breaking point between projectile and cartridge case, so that very high precision can be achieved with regard to the reproducibility of the initial velocity of the projectile and its range. This construction has proven its value thousands of times in practice, both as dummy ammunition for training purposes and as live ammunition.

In this known cartridged ammunition the tracer composition extends into the projectile body, so that the space thereof cannot be used for the service charge, whether a practice charge or a live charge.

OBJECTS AND SUMMARY OF THE INVENTION

According to the invention it is now proposed that the tracer composition usually received in a tube protrude into the high-pressure space so as to be pulled out of the high-pressure space after the rated breaking point breaks open upon expulsion of the projectile. This simultaneously enlarges the volume of the high-pressure space.

This construction achieves substantially two advantages.

Through this construction the tracer composition can protrude from the rear of the projectile, like a tail so to speak, so that the volume of the projectile can be used almost completely for the service charge.

In addition, by pulling the tracer composition out of the high-pressure space one enlarges the volume thereof upon expulsion of the projectile. This has the advantage of preventing steep pressure peaks. It achieves an advantage explained in the abovementioned EP-B-0215024 for a further embodiment in which the high-pressure space is formed by two concentrically disposed shells to be pulled out upon expulsion of the projectile. The volume enlargement of the high-pressure space likewise contributes to a constant, almost temperature-independent initial velocity of the projectile that one achieves firing effects reproducible in a wide temperature range.

With the construction according to the invention one can control the march of pressure in the high-pressure and low-pressure spaces so that no steep gas peaks occur, the pressure in the high-pressure space still rising even after the tracer composition is pulled out. Pressure control is further possible since the free end of the tracer composition is covered e.g. by a cap with one or more openings which more or less closes the high-pressure space after the tracer composition is pulled out thereof. If the openings are accordingly dimensioned the constriction ratio of the propellant composition, i.e. the ratio of the burning surface of the propellant composition to the narrowest cross section of the exit or jet openings, can be adjusted so that the total pressure for expelling the projectile is substantially constant.

The walls of the high-pressure space are usually made of steel. This has the advantage that the overflow openings out of the high-pressure space do not erode despite the high temperature of the combustion gases of the propellant composition, i.e. they substantially retain their diameter during burning, so that well reproducible firing effects are obtained. On the other hand, steel execution increases the weight of the practice cartridge. If the walls of the high-pressure space are made of aluminum for reasons of weight, however, the overflow openings erode very greatly. Furthermore, the burning aluminum particles are driven out of the launcher tube, thereby producing a relatively strong muzzle flash. This is undesirable. It has now been found that the erosion of the overflow openings and thus also the muzzle flash can be greatly reduced if the high-pressure chamber is made of aluminum and the walls of at least the overflow openings are anodized.

Further embodiments of the invention can be found in the subclaims.

DESCRIPTION OF THE DRAWINGS

The invention will be explained more closely in an embodiment with reference to the drawing, in which.

DESCRIPTION OF THE PREFERRED EMBODIMENT

Figure 1:
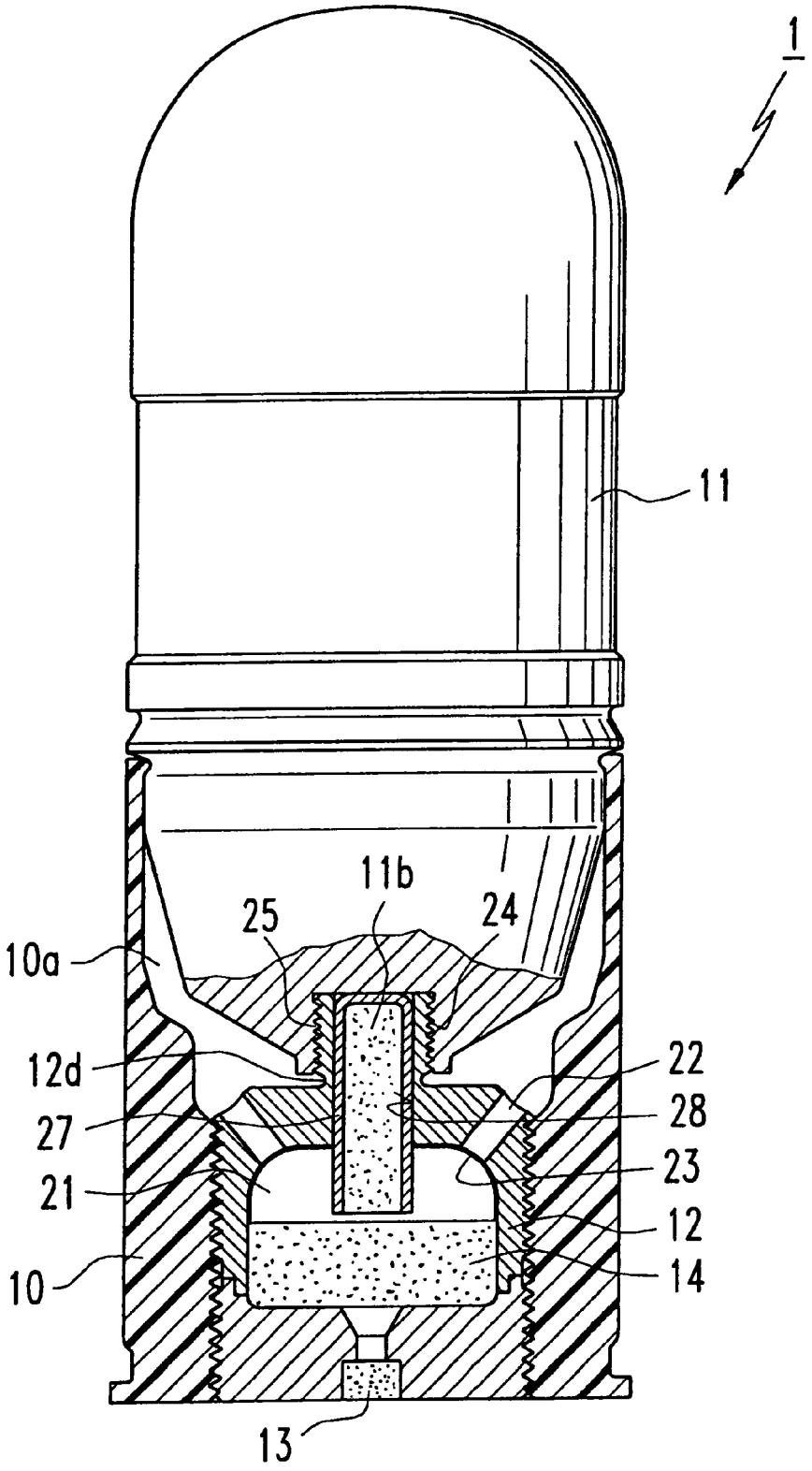
FIG. 1 shows a partly sectional representation of cartridged practice ammunition according to the invention comprising a projectile and a cartridge case.
Figure 2:
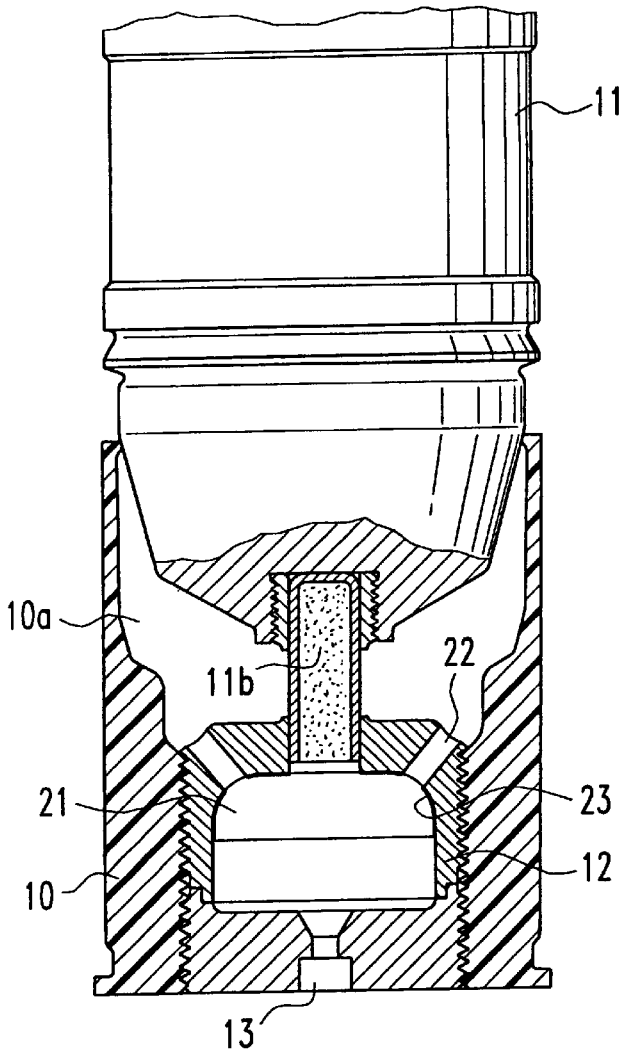
FIG. 2 shows the ammunition after the projectile has been separated from the cartridge case.
Figure 3:
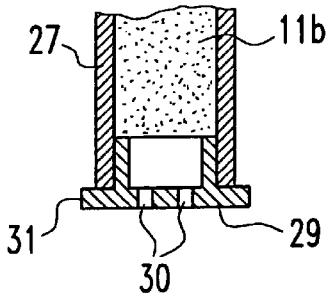
FIG. 3 shows an enlarged sectional representation of a tracer composition for cartridged ammunition according to the invention.

FIG. 1 shows a partly sectional representation of cartridged ammunition 1 with a 40 mm caliber. Ammunition 1 includes cartridge case 10 made e.g. of plastic, having disposed in its opening projectile 11 which carries for example a smoke charge as a service charge and tracer composition 11*b* disposed at the rear of the projectile. Cartridge 12 screwed into the bottom of the cartridge case contains ignition charge 13 and propelling charge 14. Cartridge 12 limits high-pressure space 21 in which propelling charge 14 burns down after being ignited by ignition charge 13. Cartridge 12, or at least the walls limiting the high-pressure space, are made of steel. High-pressure space 21 is connected via a plurality of overflow openings 22, which are first covered by tamping 23, with low-pressure space 10*a* forming the interior of the cartridge case and limited by the walls of the cartridge case and the base of projectile 11.

Cartridge 12 is provided on its upper side with upwardly protruding thread 24 onto which corresponding inside thread 25 at the rear of projectile 11 is screwed. Rated breaking point 12*d* is provided in the area of transition between the upper wall of cartridge 12 and thread 24. At the rear of projectile 11 tracer composition 11*b* is provided within inside thread 25, being received in tube 27 protruding from the rear of the projectile. Tube 27 protrudes through opening 28 in the upper wall of the cartridge into high-pressure space 21, tube 27 being mounted in opening 28 in sliding and approximately gastight fashion.

The mode of functioning of the described ammunition is as follows.

After ignition of igniting composition 13 propelling charge 14 is ignited so that a high pressure builds up through the propellant gases in high-pressure space 21, finally bursting tamping 23 at the overflow openings so that low-pressure space 10*a* is also filled via these overflow openings. Through the pressure of the propellant gases tracer composition 11*b* is furthermore ignited. As soon as the forces acting on the base of the projectile exceed a certain value, rated breaking point 12*d* tears open, whereupon projectile 11 is expelled from the cartridge case. Since tube 27 of tracer composition 11*b* is thereby also pulled out of high-pressure space 21, the volume thereof is enlarged.

To control the march of pressure for expelling the projectile from the cartridge case, one can cover the free end of tube 27 for tracer composition 11*b* by cap 29 in which a plurality of openings 30 are provided. The cap protrudes with small flange 31 over the outside diameter of tube 27 so that when projectile 11 is expelled cap 29 remains on the edge of opening 28 in high-pressure space 21 and does not fly with the projectile. Thus opening 28 is not unblocked completely after the tracer composition is pulled out, as in the embodiment according to FIG. 1, but only to a extent predetermined by the dimensions of openings 30. By dimensioning openings 30 accordingly one can control the march of pressure very precisely.

In this embodiment tube 27 of tracer composition 11*b* protrudes into high-pressure space 21 over a distance which corresponds approximately to the diameter of tube 27. It should be pointed out that this dimensioning is arbitrary; the only important thing is that enlargement takes place while the projectile is expelled until it is finally released from the cartridge case.

One can also influence the aerodynamic properties of projectiles by suitable shaping, in particular of diameter, cross section and length of the rear-side tracer composition.

Figure 4:
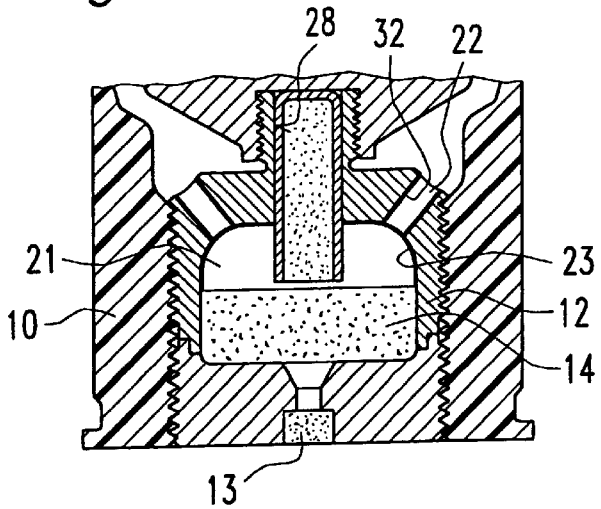
FIG. 4 shows a sectional representation of a cartridge of the practice ammunition with aluminum walls.

FIG. 4 shows a cross section through the base area of the practice ammunition. The reference signs for the individual components are the same as in the preceding figures. Cartridge 12 or its walls in the area of high-pressure space 21 are not made of steel but of aluminum this time, whereby at least the walls of overflow openings 22 are then anodized, which is indicated by 32.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed:

1. Cartridged ammunition comprising a cartridge case for receiving an ignition charge and a projectile disposed in and connected to said cartridge case, the projectile having a service charge and a tracer composition positioned at a rear of the projectile, a cartridge located centrally in the cartridge case, said cartridge having a rated breaking point which connects the projectile to the cartridge, said cartridge defining a high-pressure space and containing a propelling charge, and a low pressure space surrounding the cartridge, said low pressure space being defined by inside walls of the cartridge case and a base of the projectile, said low pressure space being connected to said high pressure space by overflow openings, wherein the tracer composition is received in a tube protruding from a middle of a rear of said projectile and penetrating an upper wall of the cartridge, said tube being mounted in said upper wall substantially in an opening in a gastight and sliding fashion and protruding into the high pressure space, so that the tube is pulled out of the high pressure space to enlarge the volume of said high pressure space after the rated breaking point breaks open.

2. The cartridged ammunition of claim 1, wherein the overflow openings are provided with tampings, said tampings breaking open at a certain pressure within the high pressure space.

3. The cartridged ammunition of claim 2, wherein an end of the tracer composition protruding into the high pressure space is closed with a cap having openings and said cap being designed so as to remain in the high pressure space after expulsion of the projectile from the cartridge case and said cap covers the opening for the tube containing the tracer composition.

4. The cartridged ammunition of claim 3, wherein walls of the cartridge defining the high pressure area are made of steel.

5. The cartridged ammunition of claim 3, wherein walls of the cartridge defining the high pressure space are made of aluminum, and wherein at least a wall forming the overflow openings being anodized.

6. The cartridged ammunition of claim 2, wherein walls of the cartridge defining the high pressure space are made of aluminum, and wherein at least a wall forming the overflow openings being anodized.

7. The cartridged ammunition of claim 1, wherein an end of the tracer composition protruding into the high pressure space is closed with a cap having openings and said cap being designed so as to remain in the high pressure space after expulsion of the projectile from the cartridge case and said cap covers the opening for the tube containing the tracer composition.

8. The cartridged ammunition of claim 7, wherein walls of the cartridge defining the high pressure area are made of steel.

9. The cartridged ammunition of claim 7, wherein walls of the cartridge defining the high pressure space are made of aluminum, and wherein at least a wall forming the overflow openings being anodized.

10. The cartridged ammunition of claim 1, wherein walls of the cartridge defining the high pressure area are made of steel.

11. The cartridged ammunition of claim 1, wherein walls of the cartridge defining the high pressure space are made of aluminum, and wherein at least a wall forming the overflow openings being anodized.

* * * * *